US009363607B2

(12) United States Patent
Ando

(10) Patent No.: US 9,363,607 B2
(45) Date of Patent: Jun. 7, 2016

(54) PLANE-TYPE SPEAKER AND AV APPARATUS

(71) Applicant: MURATA MANUFACTURING CO., LTD., Nagaokakyo-Shi, Kyoto-fu (JP)

(72) Inventor: Masamichi Ando, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 0 days.

(21) Appl. No.: 14/600,202

(22) Filed: Jan. 20, 2015

(65) Prior Publication Data

US 2015/0131823 A1 May 14, 2015

Related U.S. Application Data

(60) Division of application No. 14/081,150, filed on Nov. 15, 2013, which is a continuation of application No. PCT/JP2012/062578, filed on May 17, 2012.

(30) Foreign Application Priority Data

May 17, 2011 (JP) ..... 2011-110156

(51) Int. Cl.
*H04R 17/00* (2006.01)
*H04R 7/10* (2006.01)
(Continued)

(52) U.S. Cl.
CPC ..... *H04R 17/00* (2013.01); *H04R 7/045* (2013.01); *H04R 7/10* (2013.01); *H04R 17/005* (2013.01); *H04R 7/18* (2013.01); *H04R 2307/025* (2013.01); *H04R 2499/15* (2013.01)

(58) Field of Classification Search
CPC ..... H04R 17/00; H04R 17/005; H04R 17/02; H04R 17/025; H04R 17/10; H04R 7/12; H04R 7/122; H04R 7/125; H04R 7/127; H04R 2440/00; H04R 2440/01; H04R 2440/05; H04R 2440/07; H04R 2217/01; H01L 41/08; H01L 41/0805; H01L 41/083; H01L 41/0926; H01L 41/0973; H01L 41/098
USPC ..... 381/190, 191, 423, 426, 430, 431, 381/386–388, 394, 395, 173; 181/157, 161, 181/167–173; 310/311, 321, 322, 328, 334
See application file for complete search history.

(56) References Cited

U.S. PATENT DOCUMENTS 3,792,204 A * 2/1974 Murayama ..... H01G 7/023 310/322
3,832,580 A * 8/1974 Yamamuro ..... H04R 17/005 252/62.9 R (Continued)

FOREIGN PATENT DOCUMENTS

CN 29330175 Y 8/2007
CN 101662718 A 3/2010

(Continued)

OTHER PUBLICATIONS

Japanese Office Action issued for counterpart Japanese application No. JP2013-515187, dispatch date Sep. 2, 2014 (English translation is attached).

*Primary Examiner* — Curtis Kuntz
*Assistant Examiner* — Joshua Kaufman
(74) *Attorney, Agent, or Firm* — Arent Fox LLP

(57) ABSTRACT

A plane-type speaker where, on one of the main surfaces of an exciter film, there are placed piezoelectric films which are expanded and contracted by sound-releasing driving signals applied thereto. An oscillation plate is secured to the excited film through frame members. The oscillation plate has a flat-plate shape and is secured to the exciter film while having a warped shape such that it is gradually spaced further away from the exciter film, with decreasing distance from the secured ends to a center area, when viewed at a side surface. This realizes a state where the exciter film is pulled outwardly with respect to the secured ends due to bending stresses therein. If sound-releasing driving signals are applied to the piezoelectric films in this state, the exciter film contracts and expands along with the expansion and contraction of the piezoelectric films, thereby causing the oscillation plate to oscillate.

12 Claims, 12 Drawing Sheets

(51) Int. Cl.
*H04R 7/04* (2006.01)
*H04R 7/18* (2006.01)

(56) References Cited

U.S. PATENT DOCUMENTS 4,047,060 A * 9/1977 Schafft ..... G10K 9/122 310/322
4,088,915 A * 5/1978 Kodama ..... H04R 17/005 310/334
4,386,241 A * 5/1983 Maeda ..... H04R 17/00 310/324
4,820,952 A 4/1989 Lee
5,115,472 A * 5/1992 Park ..... H04R 1/028 310/324
5,309,519 A * 5/1994 Park ..... H04R 1/028 381/190
5,600,197 A * 2/1997 Takeuchi ..... B41J 2/161 310/324
5,736,808 A * 4/1998 Szilagyi ..... A42B 3/30 310/322
5,767,612 A * 6/1998 Takeuchi ..... B41J 2/161 310/324
5,849,125 A * 12/1998 Clark ..... H01L 41/0926 156/222
5,867,302 A * 2/1999 Fleming ..... B81B 3/0054 310/328
5,973,441 A * 10/1999 Lo ..... H01L 41/098 310/330
5,997,671 A * 12/1999 Takeuchi ..... B32B 18/00 156/256
6,060,811 A * 5/2000 Fox ..... H01L 41/098 310/311
6,222,304 B1 * 4/2001 Bernstein ..... H01L 41/1132 310/328
6,343,129 B1 1/2002 Pelrine et al.
6,376,971 B1 4/2002 Pelrine et al.
6,543,110 B1 4/2003 Pelrine et al.
6,545,384 B1 4/2003 Pelrine et al.
6,583,533 B2 * 6/2003 Pelrine ..... F04B 35/045 310/309
6,759,769 B2 * 7/2004 Kirjavainen ..... H04R 7/02 307/400
6,781,284 B1 * 8/2004 Pelrine ..... F04B 35/00 310/330
7,034,432 B1 4/2006 Pelrine et al.
7,038,356 B2 * 5/2006 Athanas ..... H04R 17/00 310/311
7,081,701 B2 * 7/2006 Yoon ..... H01L 41/0926 310/369
7,258,533 B2 * 8/2007 Tanner ..... F04B 43/046 137/855
8,189,851 B2 * 5/2012 Booth ..... H04R 7/10 181/166
8,319,396 B2 * 11/2012 Onishi ..... B06B 1/0651 310/324
9,066,183 B2 * 6/2015 Kano ..... H04R 17/00
9,137,608 B2 * 9/2015 Takahashi ..... H04R 7/20
2001/0026626 A1 * 10/2001 Athanas ..... H04R 17/00 381/190
2002/0050769 A1 * 5/2002 Pelrine ..... F04B 35/045 310/363
2002/0122561 A1 9/2002 Pelrine et al.
2003/0052570 A1 * 3/2003 Kirjavainen ..... H04R 7/02 310/311
2003/0081802 A1 * 5/2003 Watanabe ..... H04R 17/00 381/190
2003/0214199 A1 11/2003 Heim et al.
2004/0189151 A1 9/2004 Athanas
2004/0232807 A1 11/2004 Pelrine et al.
2005/0018870 A1 * 1/2005 Tanaka ..... H04R 17/00 381/430
2005/0025330 A1 * 2/2005 Saiki ..... H04R 7/04 381/388
2005/0053257 A1 3/2005 Johnson et al.
2008/0136052 A1 * 6/2008 Pelrine ..... F02G 1/043 264/105
2008/0218031 A1 * 9/2008 Kuroda ..... H04R 17/10 310/334
2008/0245985 A1 10/2008 Heim et al.
2009/0043149 A1 * 2/2009 Abel ..... H04R 17/02 600/25
2009/0200510 A1 8/2009 Watanabe et al.
2010/0054505 A1 3/2010 Zou et al.
2010/0176322 A1 7/2010 Heim et al.
2010/0219722 A1 * 9/2010 Onishi ..... B06B 1/0651 310/348
2010/0224437 A1 * 9/2010 Booth ..... H04R 7/10 181/166
2011/0109204 A1 * 5/2011 Tajitsu ..... H01L 41/193 310/348
2015/0168237 A1 * 6/2015 Tajitsu ..... G06F 3/041 73/862.621

FOREIGN PATENT DOCUMENTS

JP S52-120820 A 10/1977
JP 125498 8/1983
JP 106298 7/1984
JP 62-73898 4/1987
JP 9-215093 8/1987
JP 2000-341793 A 12/2000
JP 2001-524278 A 11/2001
JP 2003-515919 A 5/2003
JP 2005-117217 A 4/2005
JP 2005-223410 A 8/2005
JP 2009-159350 A 7/2009
JP 2009-272978 A 11/2009
JP 2009-278498 A 11/2009
JP 2010-171927 A 8/2010
JP 2010-283867 A 12/2010
WO WO-2007-060768 A1 5/2007
WO WO-2009-139237 A1 11/2009

* cited by examiner

PLANE-TYPE SPEAKER AND AV APPARATUS

CROSS REFERENCE TO RELATED APPLICATIONS

The present application is a divisional of application Ser. No. 14/081,150, filed Nov. 15, 2013, which is a continuation of International application No. PCT/JP2012/062578, filed May 17, 2012, which claims priority to Japanese Patent Application No. 2011-110156, filed May 17, 2011, the entire contents of each of which are incorporated herein by reference.

FIELD OF THE INVENTION

The present invention relates to piezoelectric speakers employing polymer sheets with piezoelectricity.

BACKGROUND OF THE INVENTION

In recent years, there have been increasing demands for thin-type speakers, for the reason that they should be mounted in thin-type displays, and the like. Therefore, various types of thin-type speakers have been contrived.

Patent Document 1 describes a speaker structured to have a flat-plate type PolyVinylidene DiFluoride (PVDF), and electrodes formed on the opposite main surfaces thereof.

However, such conventional thin-type speakers have had the drawback of poor sound-quality characteristics, in general, since they cannot have larger depthwise sizes as in dynamic speakers.

In order to overcome this drawback, for example, a speaker in Patent Document 2 is adapted to oscillate a flat-plate type membrane made of a resin and the like, through an electromagnetic type exciter (actuator). The speaker in Patent Document 1 has an electromagnetic-type exciter which is mounted to a side surface of a membrane.

Further, a speaker in Patent Document 3 is adapted to have two flat plates placed with a predetermined interval interposed therebetween, and electromagnetic-type exciters (actuators) placed in a hollow area between these flat plates, such that the flat plates are oscillated by these exciters.

Patent Document 1: JP-A No. 2009-272978
Patent Document 2: JP-A No. 62-73898
Patent Document 3: JP-A No. 2005-117217

SUMMARY OF THE INVENTION

The speaker described in the aforementioned Patent Document 2 is provided with the electromagnetic-type exciter beside the membrane and, therefore, is shaped to have a size increased by an amount corresponding to the exciter placed therein.

Further, the speaker described in Patent Document 3 is required to have at least a thickness necessary for the exciters, since the exciters are placed between the flat plates. Further, since the exciters are placed at the opposing both ends of the flat plates, the flat plate surfaces are required to have an area increased by at least an amount necessary for the two exciters.

Accordingly, it is an object of the present invention to provide a plane-type speaker which has excellent sound-quality characteristics while having a smaller thickness and, further, has a size with substantially only an area of an oscillation surface.

A plane-type speaker according to the present invention includes a piezoelectric film, an exciter film, and an oscillation plate. The piezoelectric film is made of a piezoelectric resin provided with electrodes formed on its opposite main surfaces. The exciter film is formed from a flat plate having a main surface such that the piezoelectric film is mounted substantially entirely on the main surface thereof. The oscillation plate is secured to the exciter film, in a state where it is warped in a direction orthogonal to the main surface of the exciter film.

With this structure, the exciter film is caused to expand and contract, along with the expansion and contraction of the piezoelectric film due to a sound-releasing driving signal applied thereto. Due to the expansion and contraction of the exciter film, the oscillation plate is oscillated in the direction orthogonal to its main surface. Since the piezoelectric film is mounted on substantially the entire surface of the exciter film, the exciter film is effectively expanded and contracted due to the expansion and contraction of the piezoelectric film, which can increase the oscillation stroke of the oscillation plate. This improves the low-tone output characteristics, thereby improving the sound-quality characteristics. Further, the exciter film has the same shape as that of the oscillation plate when viewed at a front surface and, therefore, does not have an unnecessarily-larger area. Further, the depth size is constituted only by the thicknesses of the flat-plate type oscillation plate and the flat-plate type exciter film, and the depth size of the hollow area between the oscillation plate and the exciter film. Further, the depth size of the hollow area can be made to be the sum of the thickness of the piezoelectric film and the oscillation stroke of the oscillation plate. Accordingly, the depthwise size can be made smaller, namely the thickness of the speaker can be made smaller.

Further, a plane-type speaker according to the present invention includes a piezoelectric film, an exciter film, and an oscillation plate and also can have the following structure. The piezoelectric film is made of a piezoelectric resin provided with electrodes formed on its opposite main surfaces. The exciter film is constituted by a flat plate with a main surface such that the piezoelectric film is mounted substantially entirely on the main surface thereof. The oscillation plate is shaped to have a flat-plate surface which is warped in a state where the oscillation plate is not secured to the exciter film, and the oscillation plate is secured to the exciter film such that the flat-plate surface has a flattened shape with respect to the main surface of the exciter film.

With this structure, even in a state where a bending stress is being applied to the oscillation plate, the front surface of the oscillation plate, namely the front surface of the plane-type speaker, is flattened. This can improve the external appearance thereof, even in the front surface of a thin-type television, for example.

Further, the plane-type speaker according to the present invention preferably has the following structure. The oscillation plate is constituted by a flattened main flat plate, and an auxiliary plate with a smaller width than that of the main flat plate and with higher rigidity than that of the main flat plate, such that the auxiliary plate is mounted to the main flat plate. The auxiliary plate has preliminarily had a warped shape.

With this structure, it is possible to suppress degradation of the bending stress in the oscillation plate over time, due to the use of the auxiliary plate which has higher rigidity than that of the main flat plate and can be maintained at a warped state for a longer time period.

Further, in the plane-type speaker according to the present invention, preferably, the piezoelectric film is divided into a plurality of individual piezoelectric films, in a direction which is parallel with the main surface of the exciter film and, also, is along secured opposite end sides of the exciter film.

With this structure, it is possible to apply different sound-releasing driving signals to the respective individual piezoelectric films. This can realize stereo sounds.

Further, the plane-type speaker according to the present invention preferably has the following structures. The piezoelectric film includes a plurality of individual piezoelectric films which are divided into individual piezoelectric films in an area which is overlaid on the auxiliary plate, and individual piezoelectric films in an area which is not overlaid on the auxiliary plate, in a front view. The piezoelectric resin which forms the individual piezoelectric films in the area overlaid on the auxiliary plate is different from the piezoelectric resin which forms the individual piezoelectric films in the area which is not overlaid on the auxiliary plate.

With this structure, it is possible to oscillate the oscillation plate, through the piezoelectric films made of the different piezoelectric resins in the respective areas.

Further, in the plane-type speaker according to the present invention, the piezoelectric resin can be made of PolyVinylidene DiFluoride. With this structure, it is possible to efficiently oscillate the oscillation plate with respect to the sound-releasing driving signal applied thereto, due to the use of the material with a higher piezoelectric constant as the organic piezoelectric film.

Further, the plane-type speaker according to the present invention preferably has the following structure. The exciter film, the oscillation plate and the electrodes are made of a material with optical transparency. The piezoelectric resin is made of polylactic acid.

With this structure, it is possible to realize a plane-type speaker with higher optical transparency over substantially the entire surface thereof when viewed at the front surface. This can realize a so-called flat-plate type transparent speaker, which is a significantly preferable aspect for placing it on the screen of a thin-type display.

Further, the plane-type speaker according to the present invention preferably has the following structure. The exciter film, the oscillation plate and the electrodes are made of a material with optical transparency. The piezoelectric resin which forms the individual piezoelectric films in the area which is not overlaid on the auxiliary plate is made of a polylactic acid, and the piezoelectric resin which forms the individual piezoelectric films in the area overlaid on the auxiliary plate is made of a PolyVinylidene DiFluoride.

With this structure, it is possible to realize a plane-type speaker with higher optical transparency, in the other area than the area in which the auxiliary plate is placed. Further, due to the use of PolyVinylidene DiFluoride having a higher piezoelectric coefficient in the area provided with the auxiliary plate with higher rigidity, it is possible to efficiently oscillate the oscillation plate with respect to the sound-releasing driving signal applied thereto.

Further, the plane-type speaker according to the present invention preferably includes a sound-absorption member between the oscillation plate and the exciter film.

With this structure, sounds generated toward the exciter film from the oscillation plate, and sounds generated by the exciter film itself are absorbed by the sound-absorption member, which further improves the sound-quality characteristics.

Further, the plane-type speaker according to the present invention can include a flat-plate type touch panel provided on the oscillation plate. With this structure, the plane-type speaker can be provided with touch panel functions.

Further, according to the present invention, it is possible to realize an AV apparatus using the aforementioned plane-type speaker. The AV apparatus includes a flat-plate type image reproduction apparatus provided between the oscillation plate and the exciter film in the plane-type speaker, in addition to the plane-type speaker. With this structure, it is possible to realize an AV apparatus with a smaller thickness and excellent sound-quality characteristics.

Further, according to the present invention, it is also possible to realize an AV apparatus, by providing the aforementioned plane-type speaker therein, and further by providing an image reproduction apparatus on the oscillation plate.

Further, according to the present invention, it is also possible to realize an AV apparatus, by providing the aforementioned plane-type speaker therein, and by constituting the oscillation plate by an image reproduction apparatus.

With these structures, similarly, it is possible to realize an AV apparatus with a smaller thickness and with excellent sound-quality characteristics.

With the present invention, it is possible to realize a thin-type plane-type speaker with excellent sound-quality characteristics and with a size with substantially only an area of an oscillation surface.

DETAILED DESCRIPTION OF THE INVENTION

Figure 1:
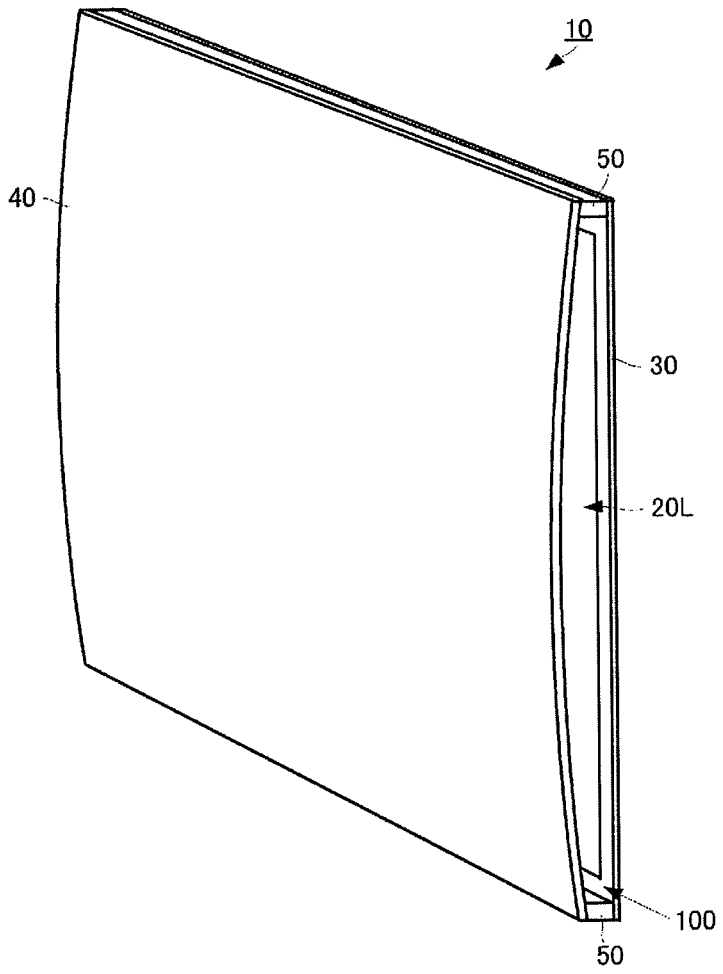
FIG. 1 is a perspective view of the external appearance of a plane-type speaker 10.
Figure 2A:
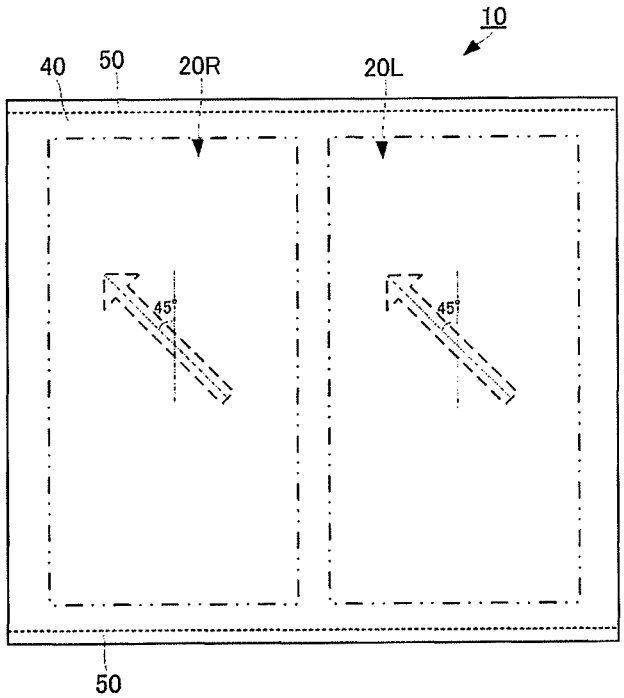
FIG. 2(A) is a front view of the plane-type speaker 10.
Figure 2B:
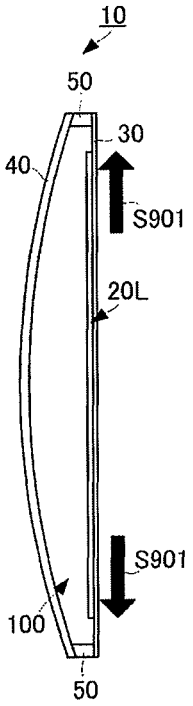
FIG. 2(B) is a side view of the same.
Figure 3:
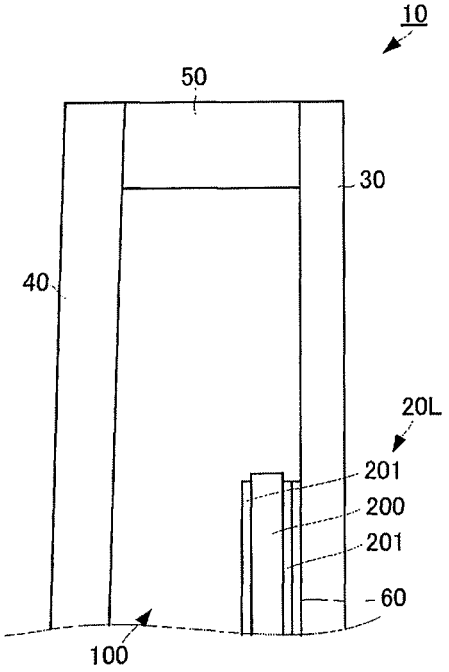
FIG. 3 is a partially-enlarged side view of the plane-type speaker 10.

A plane-type speaker according to a first embodiment of the present invention will be described, with reference to the drawings. FIG. 1 is a perspective view of the external appearance of the plane-type speaker 10 according to the present embodiment. FIG. 2(A) is a front view of the plane-type speaker 10, and FIG. 2(B) is a side view of the same. FIG. 3 is a partially-enlarged side view of the plane-type speaker 10.

The plane-type speaker 10 includes piezoelectric films 20R and 20L, an exciter film 30, an oscillation plate 40, and flame members 50. The piezoelectric films 20R and 20L are constituted by the same component, but they are attached to the exciter film 30 at different positions. Accordingly, they will be described in detail regarding their structure, with respect to the piezoelectric film 20L.

The piezoelectric film 20L includes a base film 200 having a rectangular shape in a plan view, and electrodes 201 formed on the opposing both main surfaces of the base film 200. The base film 200, which is a film having piezoelectricity, is preferably formed from a polylactic acid (hereinafter, referred to as a PLA) or a PolyVinylidene DiFluoride (hereinafter, referred to as a PVDF). More preferably, the base film 200 is formed from a PLA. By forming the base film 200 from a PLA, it is possible to make the base film 200 have significantly-higher optical transparency. If the base film 200 is to be used in such a manner as to induce no problem even when the base film 200 has poor optical transparency, it is also possible to employ a laminated-layer member formed from PVDF films having smaller thicknesses or a laminated-layer member formed from PLA films having smaller thicknesses. By doing this, it is possible to increase the apparent piezoelectric constant of the piezoelectric film, thereby enabling reduction of the voltage for driving the piezoelectric film. When the base film 200 is formed from a PLA, it is preferable to cut it such that each of the outer peripheral sides thereof forms an angle of about 45 degrees with respect to the direction of drawing, in order to form the base film 200 to have a rectangular shape.

The electrodes 201 are formed substantially entirely on the both main surfaces of the base film 200. Preferably, the electrodes 201 are mainly formed from a tin-doped indium oxide (ITO), a Zinc oxide (ZnO), or a polythiophene. By employing these materials having higher optical transparency, in combination with the base film 200 formed from a PLA, it is possible to realize the piezoelectric film 20L which is substantially transparent (with a visible-light transmittance of about 95%) or more transparent. Further, the electrodes 201 can be also constituted by silver-nanowire electrodes and, more preferably, the electrodes 201 are constituted by vaporized-aluminum electrodes, provided that they are to be used in such a manner as to induce no problem even when they have poor optical transparency. Lead-out wiring conductors, which are not illustrated, are connected to the electrodes 201, such that sound-releasing driving signals from the outside are applied to the respective electrodes 201 through these wiring conductors.

The exciter film 30 has a rectangular shape in a plan view and is made to have a size enough to place the piezoelectric films 20R and 20L thereon with a predetermined interval interposed therebetween. The exciter film 30 is formed from a Polyethylene terephthalate (PET). However, the exciter film 30 may be also formed from other materials, such as Polyethylene Naphthalate (PEN), polyethylene (PE), polypropylene (PP), polyvinyl chloride (PVC), and, further, may be formed from any insulating materials with higher optical transparency and with strengths enough to sufficiently maintain the shape of the oscillation plate 40, regarding its functions.

For example, in cases where the base film 200 in the piezoelectric film 20L is formed from a PLA, and the exciter film 30 is formed from a PET, it is preferable to make the exciter film 30 have a thickness of about 0.05 mm to 0.2 mm.

The piezoelectric films 20R and 20L are placed on one of the main surfaces of the exciter film 30 with a predetermined interval interposed therebetween. The piezoelectric films 20R and 20L are placed along the longitudinal direction of the exciter film 30 and are secured to the exciter film 30 through an adhesive layer 60.

In this case, the piezoelectric films 20R and 20L are secured thereto such that the drawing direction thereof forms an angle of 45 degrees with respect to the short direction of the exciter film 30.

The oscillation plate 40 has a rectangular shape in a plan view. The oscillation plate 40 has a shape which has substantially the same length in the longitudinal direction as that of the exciter film 30 and further has a length in the short direction which is larger than that of the exciter film 30. The oscillation plate 40 is formed from an acrylic resin (PMMA). The oscillation plate 40 may be also formed from other materials, such as PET, polycarbonate (PC), PLA and, further, may be formed from any insulating materials with higher optical transparency regarding its functions.

The oscillation plate 40 is secured, at its opposite ends in the short direction, to the opposite ends of the exciter film 30 in the short direction, through the frame members 50. The frame members 50 have an elongated rod shape and are made of a material with a high strength, such as a metal. Further, the oscillation plate 40 is secured to the exciter film 30 in its side on which the piezoelectric films 20L and 20R are mounted. However, the oscillation plate 40 may be also secured to the exciter film 30 in the opposite side thereof from the side on which the piezoelectric films 20L and 20R are mounted.

With this structure, a hollow area 100 is formed between the oscillation plate 40 and the exciter film 30. Further, the side in which there exists the oscillation plate 40 forms the front-surface side of the plane-type speaker 10, while the side in which there exists the exciter film 30 forms the rear-surface side of the plane-type speaker 10.

In this case, as illustrated in FIGS. 1 and 2(B), the oscillation plate 40 is secured to the exciter film 30, such that it is shaped to be warped and protruded toward the opposite side (the side in front of the oscillation plate 40) from the side in which there exists the exciter film 30 (the side in the rear of the oscillation plate 40). Further, FIGS. 1, 2, 3 and 4 exaggeratedly illustrate the warpage of the oscillation plate 40, but, in actual, the main surface of the oscillation plate 40 has a relationship closer to parallelism with the main surface of the exciter film 30.

Further, it is preferable that the amount of protrusion due to its warpage is not large. This is because, if the amount of protrusion due to its warpage is large, namely if the amount of its flection is excessively large, the contraction and expansion of the exciter film 30, which will be described later, are not transformed into oscillations of the oscillation plate 40 in the forward and rearward directions (in the direction orthogonal to the centers of the main surface of the exciter film 30 and the main surface of the oscillation plate 40).

If the oscillation plate 40 being subjected to a bending stress as described above is secured to the exciter film 30, as indicated by thick arrows S901 in FIG. 2(B), this realizes a state where a pulling tension is applied to the exciter film 30 along the direction which is parallel with the main surface of the exciter film 30 and, further, is orthogonal to the opposite end sides of the exciter film 30 to which the oscillation plate 40 is secured (in the short direction of the flat plate surface of the exciter film 30).

Figure 4A:
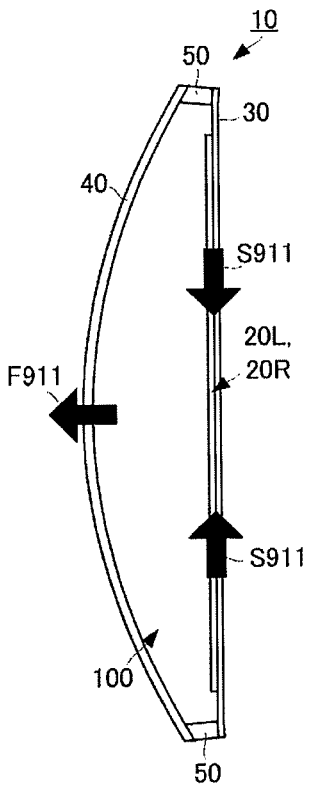
FIGS. 4(A) to 4(C) are views for explaining operations of the plane-type speaker 10.
Figure 4B:
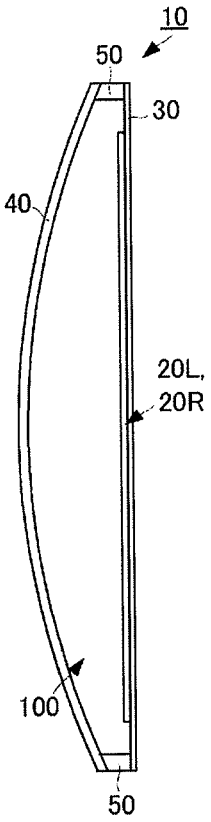
Figure 4C:
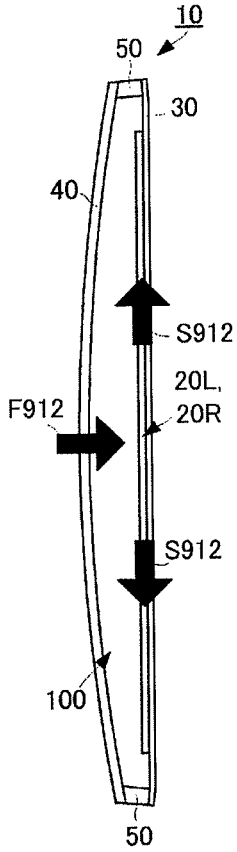

By applying a sound-releasing driving signal to the plane-type speaker 10 which has the aforementioned structure in a state where no sound-releasing driving signal is applied thereto, the oscillation plate 40 is caused to oscillate as illustrated in FIG. 4, thereby releasing sounds in the forward direction of the plane-type speaker 10. FIG. 4 is a view for explaining operations of the plane-type speaker 10, wherein FIG. 4(A) illustrates a state at timing when the piezoelectric films 20L and 20R have been contracted by the sound-releasing driving signal. FIG. 4(B) illustrates a state when no sound-releasing driving signal is being applied thereto or the sound-releasing driving signal has an amplitude of zero. FIG. 4(C) illustrates a state thereof at timing when the piezoelectric films 20L and 20R have been expanded by the sound-releasing driving signal.

If an electric field in a first direction is applied to the piezoelectric films 20L and 20R through the sound-releasing driving signal, the piezoelectric films 200 are contracted along the direction orthogonal to the secured ends of the oscillation plate 40 and the exciter film 30 and, then, the exciter film 30 is also contracted along the direction orthogonal to its secured ends in the plane, as indicated by thick solid lines S911 in FIG. 4(A). This causes the frame members 50 at the opposite ends of the exciter film 30 to be attracted toward the center in the plane along the direction orthogonal to the secured ends. This causes the oscillation plate 40 to be further warped to protrude forwardly, as indicated by a thick solid line F911 in FIG. 4(A).

On the other hand, if an electric field in a second direction which is opposite from the first direction is applied to the piezoelectric films 20L and 20R through the sound-releasing driving signal, the piezoelectric films 20L and 20R are expanded along the direction orthogonal to the secured ends of the oscillation plate 40 and the exciter film 30, and, then, the exciter film 30 is also expanded along the direction orthogonal to the secured ends in the plane, as indicated by thick solid lines S912 in FIG. 4(C). This causes the frame members 50 at the opposite ends of the exciter film 30 to get further away from the center in the plane along the direction orthogonal to the secured ends. This causes the oscillation plate 40 to be warped with a smaller amount of protrusion in the forward direction, as indicated by a thick solid line F912 in FIG. 4(C).

As described above, with the structure according to the present embodiment, it is possible to cause the transitions to the state of FIG. 4(A) and the state of FIG. 4(C), with respect to the state of FIG. 4(B), according to the amplitude of the sound-releasing driving signal, which causes the oscillation plate 40 to oscillate along the forward and rearward directions (the direction orthogonal to the plane center of the oscillation plate 40). Thus, sounds corresponding to the sound-releasing driving signal are released forwardly.

Further, as described above, by preliminarily applying a constant bending stress to the oscillation plate 40 being in a non-operated state and, further, by applying stresses, thereto, through contractions and expansions of the exciter film 40 (contractions and expansions thereof due to contractions and expansions of the piezoelectric films 20L and 20R which have been transmitted thereto), in the same direction as that of the aforementioned bending stress, it is possible to effectively oscillate the oscillation plate 40. Further, it is possible to place the piezoelectric films 20L and 20R over substantially the entire surface of the plane-type speaker 10 in a plan view, which improves the low-tone output characteristics and, also, enables oscillating the oscillation plate 40 with highest efficiency with the determined area. Further, there is no need for an electromagnetic-type exciter as illustrated in Patent Document 2 as a prior art, which enables reduction of the size of the plane-type speaker 10 (reduction of the area thereof in a front view). Further, it is possible to place the oscillation plate 40 and the exciter film 30 to which the piezoelectric films 20L and 20R are attached, in such a way as to separate them from each other by only an amount enough to provide a slight margin in addition to the oscillation stroke of the oscillation plate 40, in a side view. This hardly necessitates a depthwise length as illustrated in Patent Document 3 as a prior art, which enables forming the plane-type speaker 10 to have a reduced thickness.

Further, sounds are released in the side closer to the exciter film 30 with respect to the oscillation plate 40, but, in the aforementioned structure, the side closer to the exciter film 30 with respect to the oscillation plate 40 functions as an enclosure of a semi-closed space. This can inhibit sounds emitted in the side closer to the exciter film 30 from being leaked forwardly, thereby improving the sound-quality characteristics. Also, it is possible to place, in the hollow area 100, a sound-absorption member made of a silicon gel and the like which has flexibility enough not to obstruct the oscillation of the oscillation plate 40 and the expansion and contraction of the exciter film 30. By using such a sound-absorption member, it is possible to inhibit sounds released in the side closer to the exciter film 30 as described above from coming around forwardly and, further, it is possible to inhibit resonant sound waves generated from the exciter film 30 from propagating to the oscillation plate 40, thereby attaining improvement regarding the sound distortion rate. This can realize the plane-type speaker with more excellent sound-quality characteristics.

Further, in the aforementioned aspect employing a PLA, it is possible to realize the plane-type speaker with higher optical transparency and with excellent sound quality, which is suitable for aspects in which it is placed on the screen of a thin-type television, for example.

On the other hand, although the types of sound-releasing driving signals to be applied to the piezoelectric films 20R and 20L have not been mentioned in detail in the aforementioned description, it is possible to apply either the same sound-releasing driving signal or different sound-releasing driving signals to the piezoelectric films 20L and 20R. In cases where different types of sound-releasing driving signals are applied to the piezoelectric films 20L and 20R, it is possible to apply L-channel signals and R-channel signals for stereophonic sounds in synchronization with each other. This enables releasing stereophonic sounds through the plane-type speaker 10.

Figure 5:
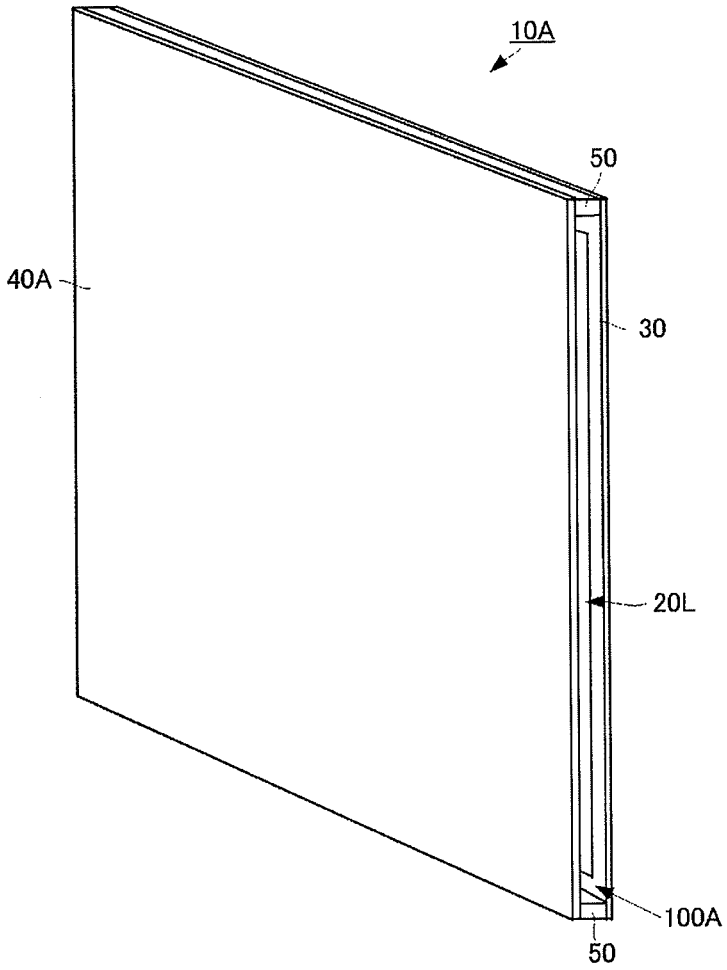
FIG. 5 is a perspective view of the external appearance of a plane-type speaker 10A.

Next, a plane-type speaker according to a second embodiment will be described with reference to the drawings. FIG. 5 is a perspective view of the external appearance of a plane-type speaker 10A according to the present invention. FIG. 6 is a view for explaining the structure of the plane-type speaker 10A, wherein FIG. 6(A) illustrates a state before an oscillation plate 40A is secured thereto, and FIG. 6(B) illustrates a state where the oscillation plate 40A has been secured thereto.

The plane-type speaker 10A according to the present embodiment is different from the plane-type speaker 10 illustrated in the first embodiment, in that the oscillation plate 40A is secured to an exciter film 30 such that the main surface of the oscillation plate 40A is parallel with the main surface of the exciter film 30, but is the same in terms of the other structures.

Figure 6A:
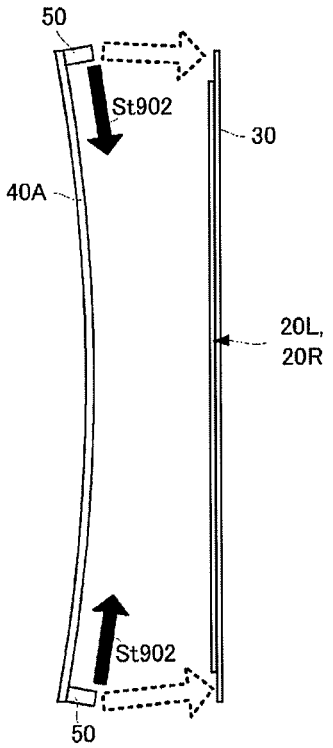
FIGS. 6(A) and 6(B) are views for explaining the structures of the plane-type speaker 10A.

The oscillation plate 40A is made of the same material as that of the oscillation plate 40 illustrated in the first embodiment, but it has preliminarily had a warped shape as illustrated in FIG. 6(A). This can be realized by bending an oscillation plate with a flat main surface through thermal treatment and the like, for example.

Figure 6B:
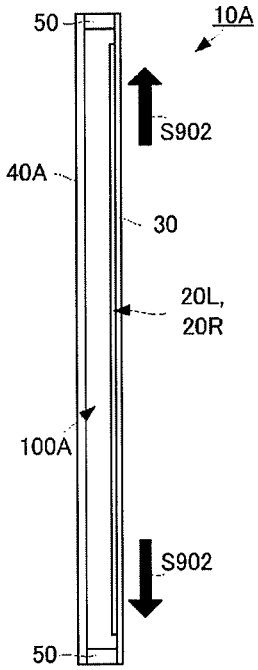

The oscillation plate 40A having this shape is secured to the exciter film 30 through frame members 50 such that its main surface forms a flat surface as illustrated in FIG. 6(B), while external forces are applied thereto in the directions of thick arrows St902 in FIG. 6(A) such that the protrusion of its warpage is directed toward the exciter film 30. By securing it in this state, as indicated by thick arrows S902 in FIG. 6(B), the exciter film 30 is pulled in the directions toward its secured ends from its center in the direction which is parallel with the main surface and, also, is orthogonal to its opposite end sides to which the oscillation plate 40 is secured. This realizes a state where stresses have been accumulated therein, similarly to in the aforementioned first embodiment.

With this structure, similarly, it is possible to offer the same effects and advantages as those of the aforementioned first embodiment. Further, with the structure according to the present embodiment, the oscillation plate 40A can be secured therein such that its main surface is flattened, which makes the plane-type speaker 10A have preferable appearances when viewed at its front surface, at its side surfaces and obliquely at its front side, thereby making the plane-type speaker 10A more suitable for aspects where it is placed in the screen of a flat-panel thin-type television as described above.

Figure 7:
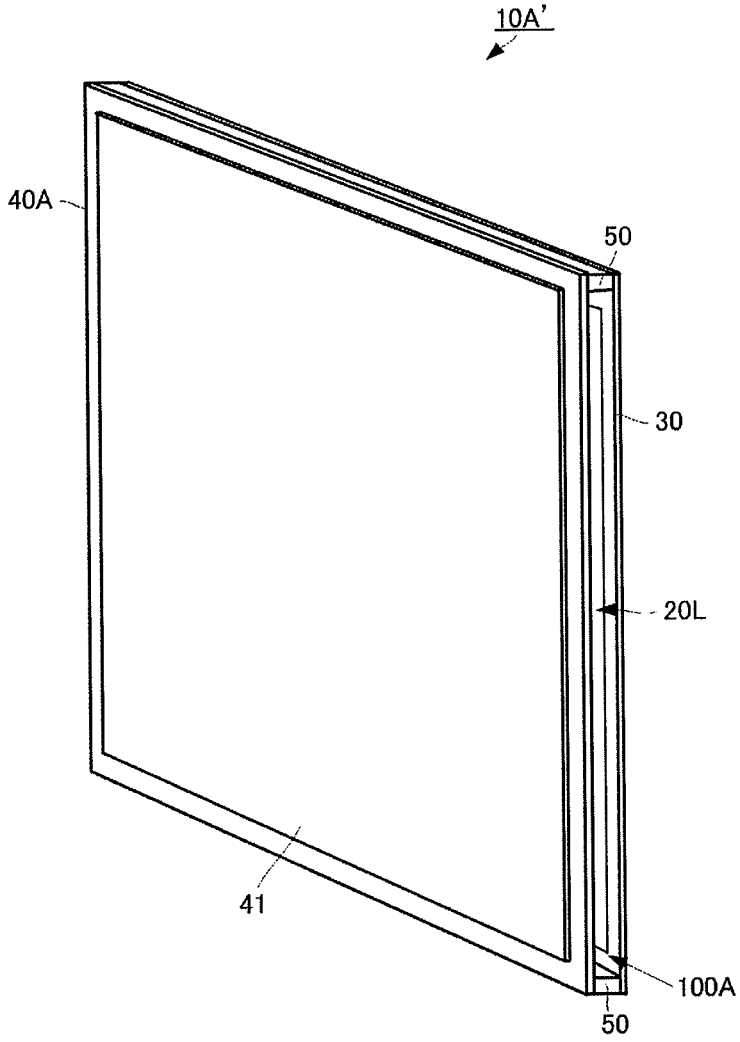
FIG. 7 is a perspective view of the external appearance of a plane-type speaker 10A'.

Further, since the front surface of the plane-type speaker 10A can be made to be a flat surface, it is possible to attach a flat-panel type touch panel device to the front surface of the oscillation plate 40A, in order to make the plane-type speaker have touch panel functions. FIG. 7 is a perspective view of the external appearance of a plane-type speaker 10A' having a touch panel device attached to the oscillation plate. The plane-type speaker 10A' is structured by attaching a touch panel 41 to the surface of the oscillation plate 40A (the opposite surface from its surface facing the exciter film) in the plane-type speaker 10A' illustrated in the second embodiment. Further, it is also possible to realize the oscillation plate 40A using a flat-panel type touch panel device.

Figure 8:
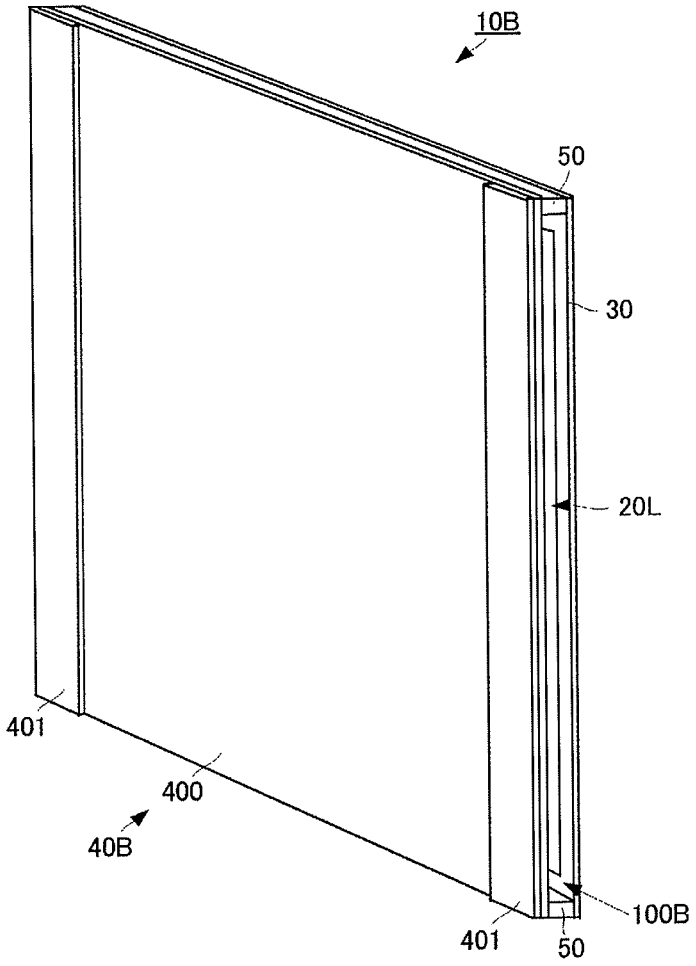
FIG. 8 is a perspective view of the external appearance of a plane-type speaker 10B.
Figure 9A:
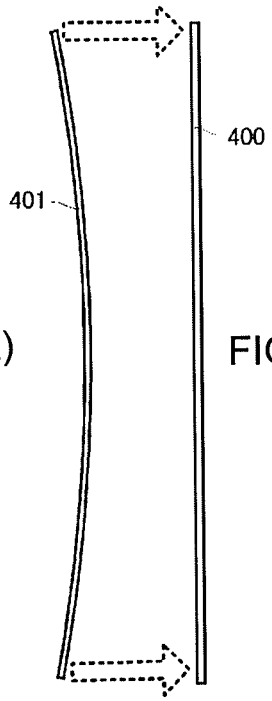
FIGS. 9(A) to 9(C) are views for explaining the structures of the plane-type speaker 10B.
Figure 9B:
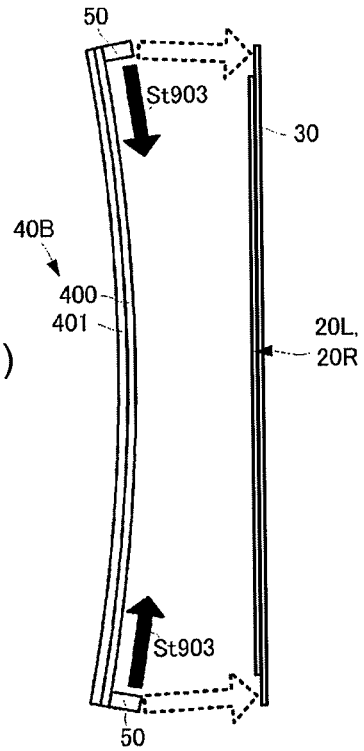
Figure 9C:
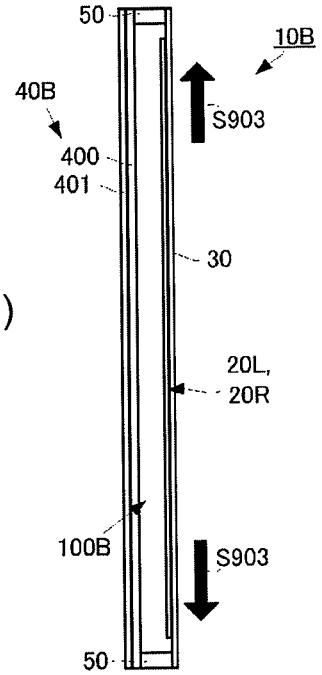

Next, a plane-type speaker according to a third embodiment will be described with reference to the drawings. FIG. 8 is a perspective view of the external appearance of a plane-type speaker 10B according to the present embodiment. FIG. 9 is a view for explaining the structure of the plane-type speaker 10B, wherein FIG. 9(A) illustrates a side surface of an oscillation plate 40B in an exploded state, and an assembled state thereof, FIG. 9(B) illustrate a state where the oscillation plate 40B is secured, and FIG. 9(C) illustrates a state where the oscillation plate 40B has been secured.

The oscillation plate 40B is constituted by a main flat plate 400, and a pair of auxiliary plates 401. The main flat plate 400 is made of the same material and has the same shape as that of the oscillation plate 40 illustrated in the first embodiment. The auxiliary plates 401 are placed on the opposite ends of the main flat plate 400 in the longitudinal direction, namely near the two end sides thereof which are orthogonal to the sides of the oscillation plate 40B and the exciter film 30 which are secured to each other.

The auxiliary plates 401 have an elongated shape having the same length as the length of the main flat plate 400 in the short direction and having a smaller width. The auxiliary plates 401 are made of a high-performance spring material. More specifically, preferable materials of the auxiliary plates 401 include SUS301CSP, SUS304CSP, spring-dedicated beryllium coppers C1700 and C1720, spring-dedicated phosphor bronze C5210, spring-dedicated nickel silver C7701. It is preferable that the auxiliary plates 401 have a thickness of about 0.3 mm to 0.8 mm. The hardness of the auxiliary plates 401 is higher than the hardness of the main flat plate 400 and is determined depending on the size of the oscillation plate.

The auxiliary plates 401 have been preliminarily formed to have a warped shape. The auxiliary plates 401 are mounted on the main flat plate 400, in a state where the protrusion of its warpage is toward the main flat plate 400. Since the main flat plate 400 has lower hardness than that of the auxiliary plates 401, the main flat plate 400 is warped in a shape conforming to the shape of the warpage in the auxiliary plates 401. This results in the formation of the oscillation plate 40B having a warped shape as illustrated in FIG. 9(B).

The oscillation plate 40B having this shape is secured to the exciter film 30 through frame members 50 such that its main surface forms a flat surface as illustrated in FIG. 9(C), while external forces are applied thereto in the directions of thick arrows St903 in FIG. 9(B) such that the protrusion of its warpage is directed toward the exciter film 30. By securing it in this state, as indicated by thick arrows S903 in FIG. 9(C), the exciter film 30 is pulled in the direction toward its secured ends from its center in the short direction. This realizes a state where stresses have been accumulated therein, similarly to in the aforementioned first and second embodiments.

With this structure, similarly, it is possible to offer the same effects and advantages as those of the aforementioned first and second embodiments. Further, with the structure according to the present embodiment, the oscillation plate 40B can be secured thereto such that its main surface is flattened, similarly to in the second embodiment. Further, with the present embodiment, due to the use of the auxiliary plates 401, which exhibit less degradation over time than that of the main flat plate 400 made of an acrylic resin or the like, for applying a bending stress, it is possible to realize the plane-type speaker capable of accumulating a bending stress therein in accordance with the design, for a longer time period.

Further, with the structure according to the present embodiment, the auxiliary plates 401 are made of the aforementioned metal material, which causes the areas provided with these auxiliary plates 401 to have no optical transparency.

Figure 10:
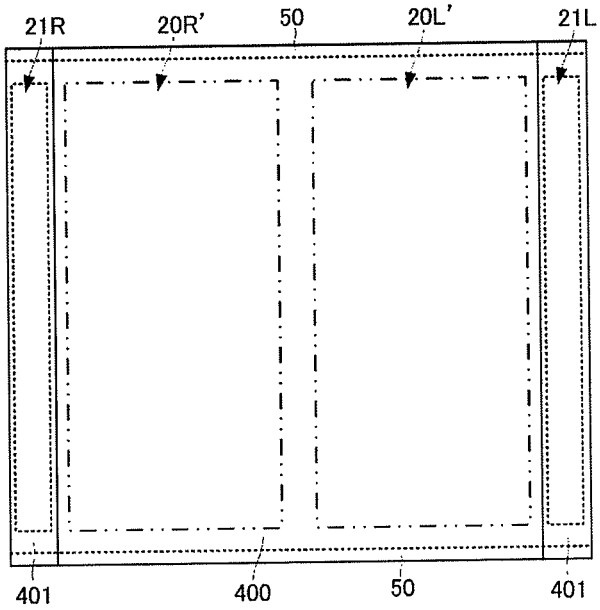
FIG. 10 is a view of piezoelectric films in the plane-type speaker 10B.

In this case, piezoelectric films can be placed such that they are separated from each other as illustrated in FIG. 10, which can realize a structure employing the piezoelectric films made of two or more materials. FIG. 10 is a view of the structure of piezoelectric films in a plane-type speaker 10B.

As illustrated in FIG. 10, as the piezoelectric films according to the present embodiment, piezoelectric films 20L' and 20R' are placed in the area in which an exciter film 30 can be viewed through an oscillation plate 40B in a plan view, along the longitudinal direction of the oscillation plate 40B and the exciter film 30. Further, piezoelectric films 21R and 21L are placed in the opposite end areas in which the exciter film 30 cannot be viewed in the plan view. The piezoelectric films 20L' and 20R' have base films made of a PLA, while the piezoelectric films 21L and 21R have base films made of a PVDF.

PVDFs have higher piezoelectric coefficient than those of PLAs and, therefore, expand and contract more largely than PLAs, when sound-releasing driving signals with the same amplitude are applied thereto. Accordingly, by partially employing the piezoelectric films 21R and 21L which are made of a PVDF, as illustrated in the present embodiment, it is possible to oscillate the oscillation plate 40B more effectively.

Further, although the piezoelectric films made of the PVDF have lower optical transparency than that of PLA, they can be placed only in the rear of the auxiliary plates 401 having no optical transparency, which can realize the plane-type speaker with optical transparency, without degrading the external appearance thereof at its front surface.

Further, since the piezoelectric films made of the PVDF which expands and contracts by larger amounts are placed in the rear of the auxiliary plates 401 with higher spring performance, it is possible to oscillate the oscillation plate 40B more effectively.

Further, PVDFs tend to reduce their impedances to allow larger electric currents to flow therethrough, in a higher frequency range, in comparison with PLAs. However, by placing the piezoelectric films 21L and 21R made of the PVDF only in the relatively-smaller areas in which the auxiliary plates 401 are placed as illustrated in the present embodiment, it is possible to reduce electric power consumption.

Further, the aforementioned respective embodiments have been described by exemplifying plane-type speakers provided with an oscillation plate and an exciter film which have rectangular shapes in a plan view. However, it is also possible to employ an oscillation plate and an exciter film which have other shapes, provided that the oscillation plate and the exciter film are secured to each other at their ends opposite to each other, which can also offer the same effects and advantages.

Figure 11:
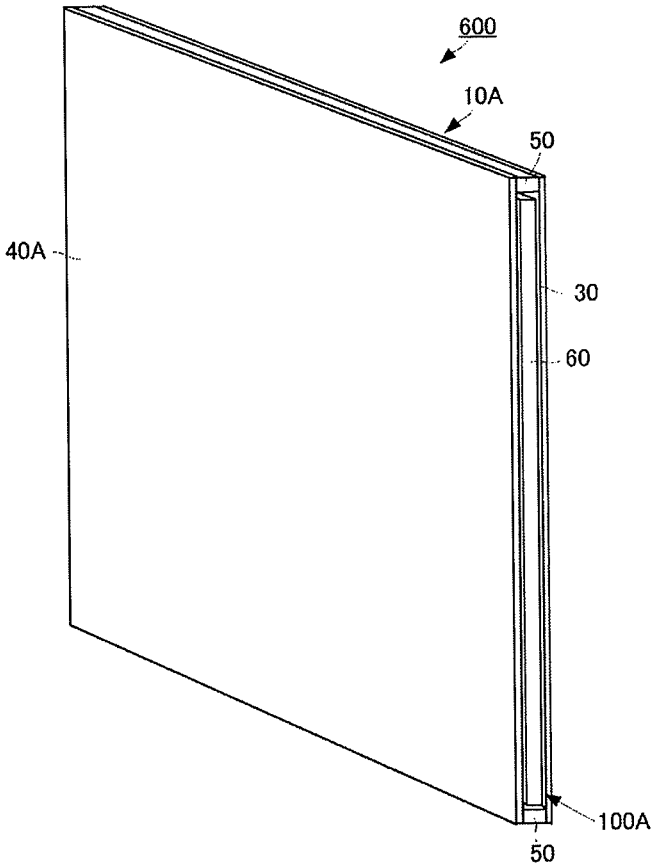
FIG. 11 is a perspective view of the external appearance of an AV apparatus 600.
Figure 12A:
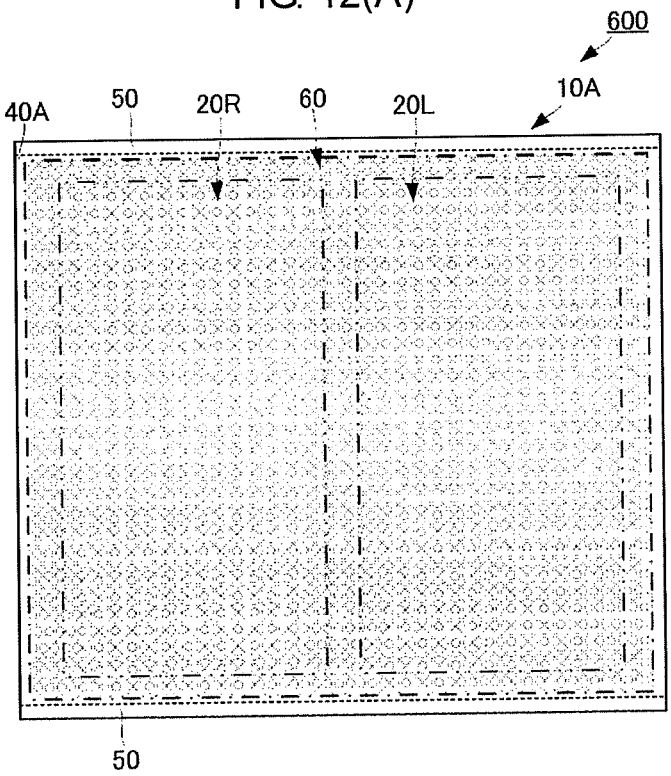
FIG. 12(A) is a front view of the AV apparatus 600.
Figure 12B:
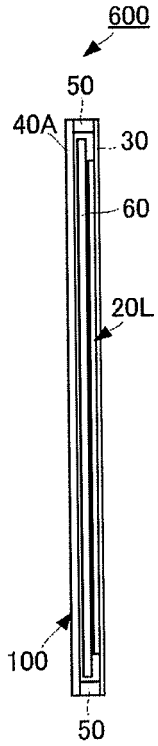
FIG. 12(B) is a side view of the same.

Further, in the aforementioned description, the plane-type speaker has been described as being placed on the foreside surface (the front surface) of an image reproduction apparatus, such as a liquid-crystal television. However, it is also possible to place an image reproduction apparatus such as a thin-type television which is constituted by a liquid crystal display, an organic EL display or the like, in the hollow area generated in the plane-type speaker. FIG. 11 is a perspective view of an AV apparatus 600 employing a plane-type speaker according to the present invention. FIG. 12(A) is a front view of the AV apparatus 600 employing the plane-type speaker according to the present invention, and FIG. 12(B) is a side view of the same. Although, hereinafter, there will be exemplified a case of employing the plane-type speaker 10A illustrated in the second embodiment, this structure can be also applied similarly to the plane-type speakers according to the other embodiments.

The AV apparatus 600 includes the plane-type speaker 10A and a thin-type display 60. The thin-type display 60 is placed in the hollow area 100A in the plane-type speaker 10A. In this case, the thin-type display 60 is placed such that its image-display surface is closer to the oscillation plate 40A. Further, the thin-type display 60 is placed such that it is spaced apart from the oscillation plate 40A by an interval corresponding to the oscillations thereof and, also, is not in contact with the piezoelectric films 20L and 20R. With this structure, it is possible to realize a thin-type AV apparatus with excellent sound quality. Further, since the oscillation plate 40A has higher optical transparency, it does not obstruct the display on the screen of the thin-type display 60 (the repeatability of images thereon, for example). Further, with this structure, it is possible to eliminate the necessity of imposing a requirement regarding optical transparency on the piezoelectric films 20L and 20R, which enables forming their entirety from a PVDF, for example, thereby further improving the sound-quality characteristics. Further, in this AV apparatus 60, similarly, a sound-absorption member can be interposed in the hollow area, together with the thin-type display 60.

Figure 13A:
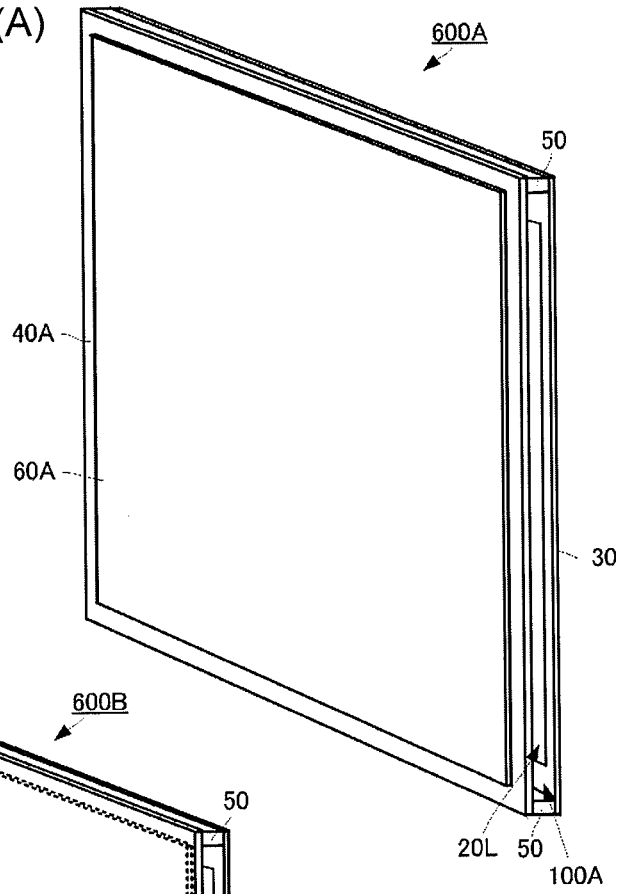
FIGS. 13(A) and 13(B) are perspective views of the external appearances of AV apparatuses 600A and 600B, respectively.
Figure 13B:
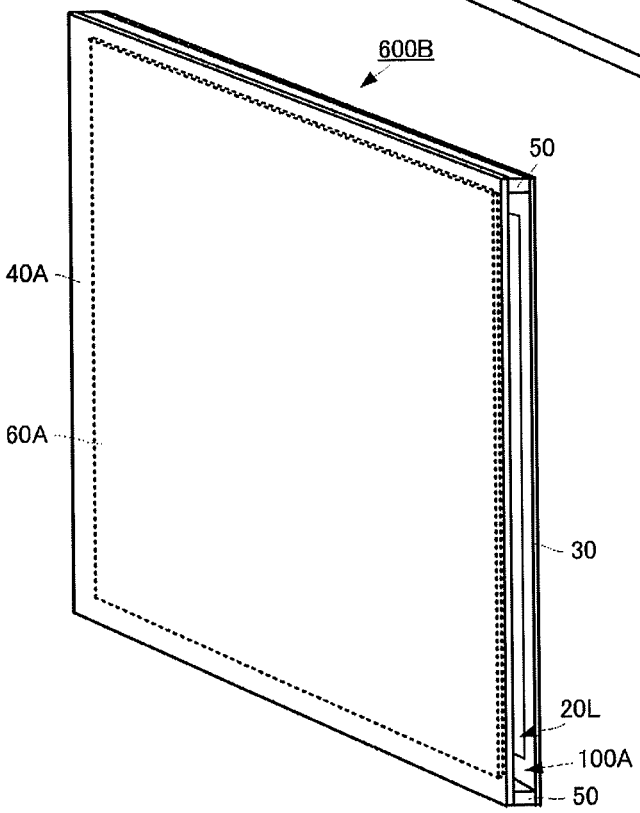

Also, it is possible to realize an AV apparatus with a structure having a thin-type display, such as an organic EL display, which is attached to an oscillation plate. FIG. 13 is perspective views of the external appearance of AV apparatuses 600A and 600B. The AV apparatus 600A illustrated in FIG. 13(A) has a plane-type-speaker having the same structure as that of the second embodiment, but is structured to have a thin-type display 60A attached to the surface of the oscillation plate 40A (the opposite surface thereof from the surface facing the exciter film). The AV apparatus 600B illustrated in FIG. 13(B) has a plane-type-speaker having the same structure as that of the second embodiment, but is structured to have a thin-type display 60A attached to the back surface of the oscillation plate 40A (its surface facing the exciter film).

Figure 14:
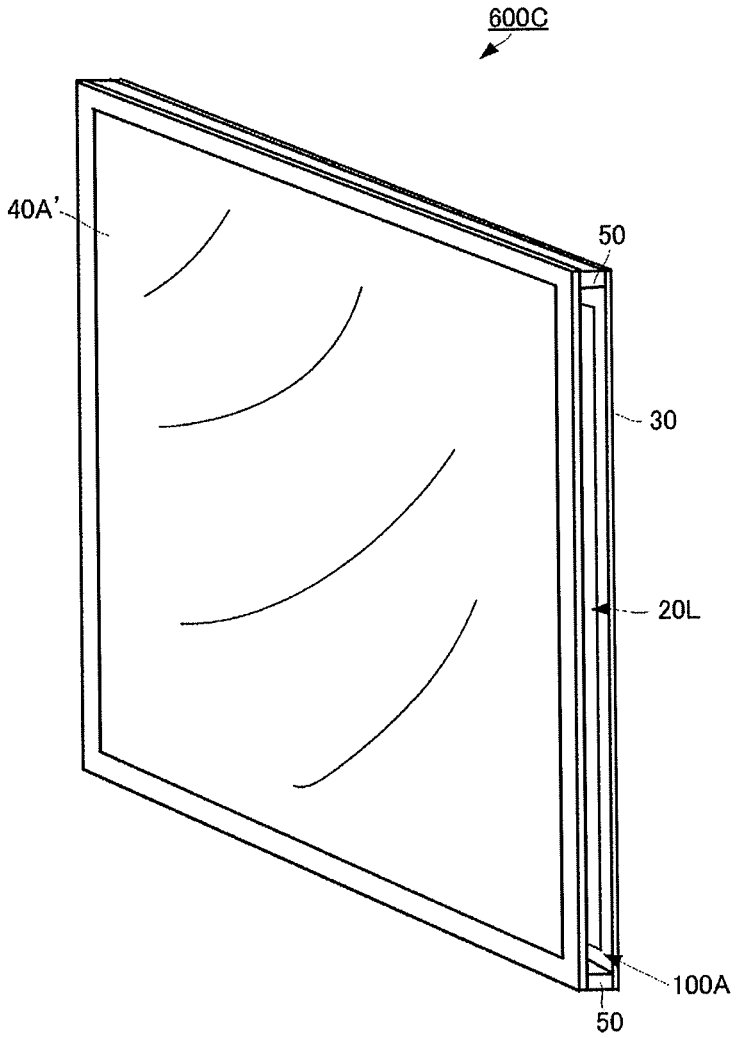
FIG. 14 is a perspective view of the external appearance of an AV apparatus 600C.

Further, it is also possible to constitute the oscillation plate by a thin-type display. FIG. 14 is a perspective view of the external appearance of an AV apparatus 600C. The AV apparatus 600C illustrated in FIG. 14 has the same basic structure as that of the second embodiment, but it employs an oscillation plate 40A' which also serves as a thin-type display. Namely, the AV apparatus 600C is provided with the oscillation plate which is constituted by a thin-type display.

With these structures illustrated in FIGS. 13 and 14, similarly, it is possible to realize thin-type AV apparatuses with excellent sound-quality characteristics.

DESCRIPTION OF REFERENCE SYMBOLS

10, 10A, 10A', 10B: Plane-type speaker
20L, 20R, 20L' 20R', 21L, 21R: Piezoelectric film
30: Exciter film
40, 40A, 40B: Oscillation plate
40A': Thin-type display/oscillation plate
41: Touch panel
50: Frame member
60, 60A: Thin-type display
100: Hollow area
200: Base film
201: Electrode
400: Main flat plate
401: Auxiliary plate
600, 600A, 600B, 600C: AV apparatus

The invention claimed is:

1. A plane-type speaker comprising:

a piezoelectric resin film having electrodes on opposed surfaces thereof;

an exciter film having a main surface upon which the piezoelectric film is mounted; and an oscillation plate having a surface which is warped in a state where the oscillation plate is not secured to the exciter film, and, when the oscillation plate is secured to the exciter film, the surface of the oscillation plate has a flattened shape with respect to the main surface of the exciter film and a constant stress is applied to the oscillation plate in a non-operated state such that a pulling tension is applied to the exciter film when the plane-type speaker is in the non-operated state.

2. The plane-type speaker according to claim 1, wherein the oscillation plate comprises a main fiat plate and an auxiliary plate mounted to the main flat plate, the auxiliary plate having a smaller width and a higher rigidity than that of the main flat plate, and the auxiliary plate having a warped shape in the state where the oscillation plate is not secured to the exciter film.

3. The plane-type speaker according to claim 2, wherein the piezoelectric resin film comprises a plurality of individual piezoelectric resin films which are divided into a first set of individual piezoelectric resin films in an area which is overlaid on the auxiliary plate, and a second set of individual piezoelectric resin films in an area which is not overlaid on the auxiliary plate, and a first resin of the first set of individual piezoelectric resin films is different from a second resin of the second set of individual piezoelectric films.

4. The plane-type speaker according to claim 3, wherein the exciter film, the oscillation plate and the electrodes are made of a material with optical transparency, and the first resin is a polylactic acid, and the second resin is a PolyVinylidene DiFluoride.

5. The plane-type speaker according to claim 1, wherein the piezoelectric resin film comprises a plurality of individual piezoelectric films, the plurality of individual piezoelectric films being divided in a direction parallel to the main surface of the exciter film and secured along opposite end sides of the exciter film.

6. The plane-type speaker according to claim 1, wherein the piezoelectric resin film is PolyVinylidene DiFluoride.

7. The plane-type speaker according to claim 1, wherein the exciter film, the oscillation plate and the electrodes arc made of a material with optical transparency, and the piezoelectric resin film is a polylactic acid.

8. The plane-type speaker according to claim 1, further comprising a sound-absorption member between the oscillation plate and the exciter film.

9. The plane-type speaker according to claim 1, further comprising a flat-plate type touch panel on the oscillation plate.

10. An AV apparatus comprising:

the plane-type speaker according to claim 1; and an image reproduction apparatus on the oscillation plate.

11. An AV apparatus comprising:

the plane-type speaker according to claim 1, and wherein the oscillation plate forms an image reproduction apparatus.

12. An AV apparatus comprising:

the plane-type speaker according to claim 1, and an image reproduction apparatus between the exciter film and the oscillation plate of the plane-type speaker.

* * * * *